US006844543B2

(12) United States Patent
Grant et al.

(10) Patent No.: US 6,844,543 B2
(45) Date of Patent: Jan. 18, 2005

(54) QUANTITATION OF ABSORBED OR DEPOSITED MATERIALS ON A SUBSTRATE THAT MEASURES ENERGY DEPOSITION

(75) Inventors: Patrick G. Grant, Walnut Creek, CA (US); Olgica Bakajin, San Leandro, CA (US); John S. Vogel, San Jose, CA (US); Graham Bench, Livermore, CA (US)

(73) Assignee: The Regents of the University of California, Oakland, CA (US)

( * ) Notice: Subject to any disclaimer, the term of this patent is extended or adjusted under 35 U.S.C. 154(b) by 0 days.

(21) Appl. No.: 10/434,590

(22) Filed: May 9, 2003

(65) Prior Publication Data

US 2004/0004183 A1 Jan. 8, 2004

Related U.S. Application Data

(60) Provisional application No. 60/393,690, filed on Jul. 3, 2002.

(51) Int. Cl.[7] ..... H01J 49/00

(52) U.S. Cl. ..... 250/281; 250/282; 250/299; 250/397

(58) Field of Search ..... 250/281, 282, 250/299, 397

(56) References Cited

U.S. PATENT DOCUMENTS 6,180,942 B1 * 1/2001 Tracy et al. ..... 250/299
6,323,475 B1 * 11/2001 Spartiotis et al. ..... 250/208.1

* cited by examiner

*Primary Examiner*—John R. Lee
*Assistant Examiner*—Paul M. Gurzo
(74) *Attorney, Agent, or Firm*—Michael C. Staggs; L. E. Carnahan; Alan H. Thompson

(57) ABSTRACT

This invention provides a system and method for measuring an energy differential that correlates to quantitative measurement of an amount mass of an applied localized material. Such a system and method remains compatible with other methods of analysis, such as, for example, quantitating the elemental or isotopic content, identifying the material, or using the material in biochemical analysis.

45 Claims, 2 Drawing Sheets

200
36
38
42
43

32
50
46

48
46
44

49
47
45

QUANTITATION OF ABSORBED OR DEPOSITED MATERIALS ON A SUBSTRATE THAT MEASURES ENERGY DEPOSITION

RELATED APPLICATION

This application claims the benefit of U.S. Provisional Application No. 60/393,690, filed Jul. 3, 2002, and entitled, "Substrates for Analysis of Deposited Biological Material," which is incorporated herein by this reference.

The United States Government has rights in this invention pursuant to Contract No. W-7405-ENG-48 between the United States Department of Energy and the University of California for the operation of Lawrence Livermore National Laboratory.

BACKGROUND OF THE INVENTION

1. Field of the Invention

The present invention relates to an apparatus and method for measuring the mass of molecules by quantitating the energy loss of directed particles. More specifically, the present invention provides a method and apparatus for direct quantitation of the amount of an applied material while remaining compatible with other methods of analysis, such as, for example, quantitating the elemental or isotopic content, identifying the material, or using the material in biochemical analysis.

2. State of Technology

Proteins are primary effectors created from genomic codes that provide fundamental structures, pathways, and regulations required in a living entity. Numerous methods exist to study proteins involved in all levels of life, from healthy cellular cultures to diseased humans. The totality of these methods are now subsumed under the rubric of "proteomics", and the current state of the art in proteomics emphasizes identification of proteins and their post-expression modification using dimensional separation followed by mass spectrometry.

However, such protein molecules and other biological molecules, such as, but not limited to, DNA, or RNA or complexes of these, are difficult to quantitate without specific standards to compare the measured response of the unknown to the measured response of the standards. Specifically, protein quantitation with general standards has an error that can be as large as about 20%. Further analysis of proteins by other methods normally require an additional aliquot (i.e., an additional representative sample), which requires more protein and involves additional pippeting and dilution errors. Although qualitative detection of specific macromolecules can be achieved with mass spectrometry techniques currently available, the quantity of the molecules cannot be accurately determined with mass spectrometry because desorption and ionization varies between molecules and is affected by the matrix of the system.

Accordingly, a need exists for accurate and sensitive mass quantitation of applied amounts of molecules on substrates while remaining compatible with multiple non-destructive and destructive methods of analysis known in the art. The present invention involves a system and method to address such a need.

SUMMARY OF THE INVENTION

Accordingly, the present invention provides a system for measuring an energy differential that correlates to a quantitative amount of mass of an applied localized material.

Another aspect of the present invention provides an energy loss detector apparatus that is additionally capable of measuring an energy differential that correlates to a quantitative amount of mass of an applied localized material.

Another aspect of the present invention provides a patterned wafer apparatus that operates as multiple detectors for measuring an energy differential that correlates to a quantitative amount of mass of an applied localized material.

A final aspect of the present invention provides a method, comprising: applying one or more localized materials on a substrate, directing a beam of particles at a respective localized material, wherein each of the respective localized materials is capable of receiving a predetermined fraction of the beam; and measuring an energy differential of a transmitted beam of particles, wherein a quantitative amount of mass of each of the localized materials is capable of being determined.

Accordingly, the invention provides a method and apparatus that measures energy deposition and correlates that measurement to a quantitative measurement of the mass of an applied material. Such a method and apparatus remains compatible with other methods of analysis to provide a complete suite of tools for researchers such as biochemists by identifying the macromolecule and quantifying the isotope and/or other elemental abundance of the same quantified aliquot.

BRIEF DESCRIPTION OF THE DRAWINGS

The accompanying drawings, which are incorporated into and form a part of the disclosure, illustrate an embodiment of the invention and, together with the description, serve to explain the principles of the invention.

DETAILED DESCRIPTION OF THE INVENTION

Figure 1:
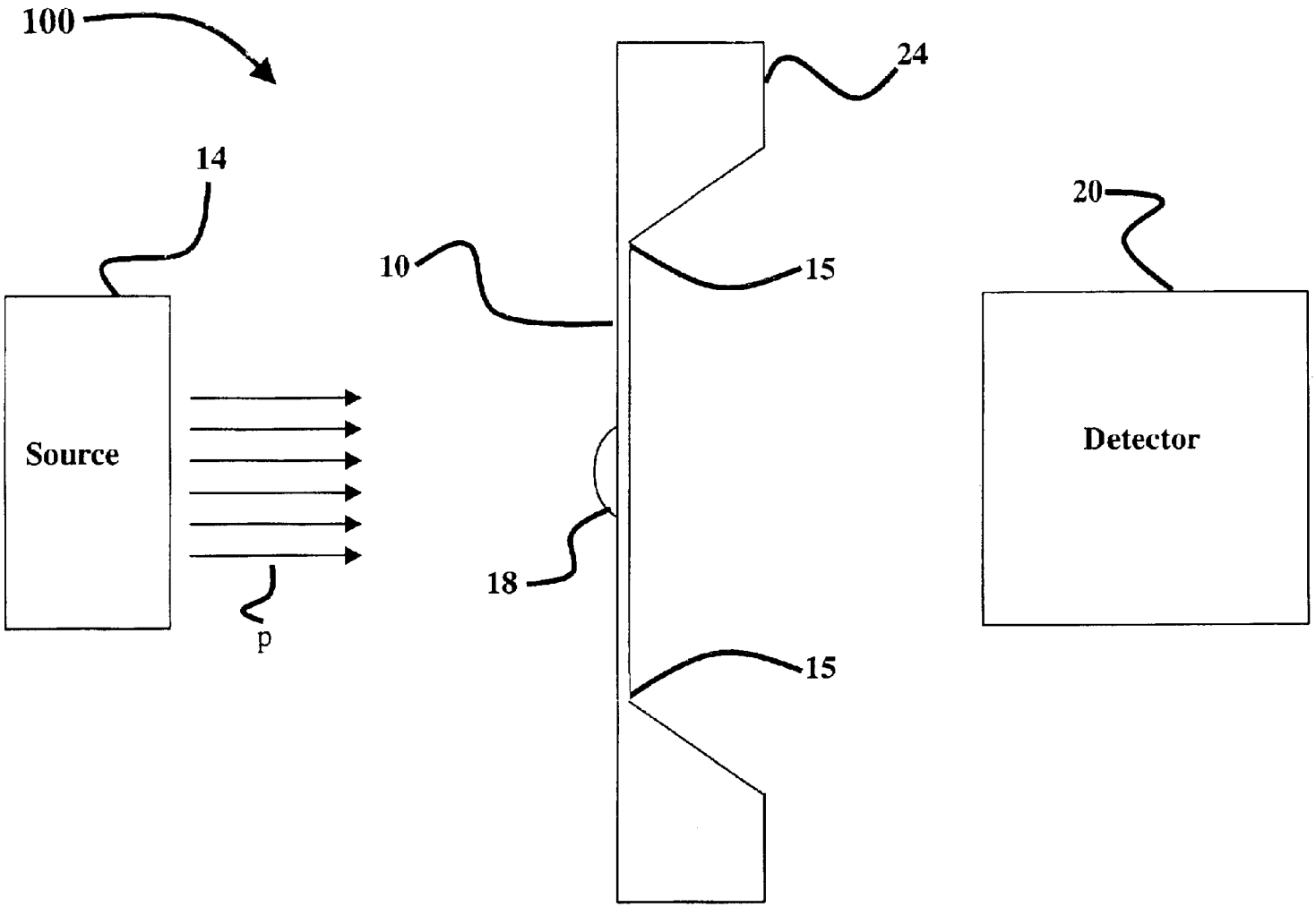
FIG. 1 illustrates a system embodiment that incorporates thin substrates.

Referring now to the following detailed information, and to incorporated materials; a detailed description of the invention, including specific embodiments, is presented. The detailed description serves to explain the principles of the invention.

Unless otherwise indicated, all numbers expressing quantities of ingredients, constituents, reaction conditions and so forth used in the specification and claims are to be understood as being modified in all instances by the term "about". Accordingly, unless indicated to the contrary, the numerical parameters set forth in the specification and attached claims are approximations that may vary depending upon the desired properties sought to be obtained by the subject matter presented herein. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the subject matter presented herein are approximations, the numerical values set forth in the specific examples are reported as precisely as possible. Any numerical value, however, inherently contain certain errors necessarily resulting from the standard deviation found in their respective testing measurements.

GENERAL DESCRIPTION

The quantity of a specific macromolecules expressed under particular cellular conditions often reflects fundamental biological responses to biochemical pressures of disease or environmental influences. The utility of, for example, a specific protein may require later incorporation of elemental or molecular moieties, and its action may result in binding to natural, nutritional, therapeutic, or toxic substrates. The study of macromolecules therefore requires more than just molecular identification but also the quantitation of an expressed protein and its affinity for a variety of natural and anthropogenic substrates. Such affinities are determined through quantitation of both the incorporated moiety as well of the incorporating macromolecule.

Accordingly, the invention as disclosed herein allows accurate analysis of less than about 10% variance of small amounts between about 0.08 and about 100 $\mu$g of macromolecules, such as, proteins, antigens, DNA, RNA, etc., or combinations thereof. Such analysis measures the mass of molecules by quantitating the energy loss of particles or x-rays attenuated by an amount of an isolated applied macromolecule, while also identifying the macromolecule and quantifying the isotope and/or elemental substance of the same quantified aliquot. Such particles can include, for example, protons, helium ions, or oxygen ions having an energy, for example, between about 3 and about 6 MeV. However, greater acceleration energies greater than 6 MeV (because of larger ions being implemented into the present invention) are additionally capable of being utilized to meet the design parameters of the present invention. In particular, as stated herein before, this invention allows direct quantitation of the amount of an applied material while remaining compatible with other methods of analysis including, quantitating the elemental or isotopic content, identifying the material, or using the material in biochemical analysis.

SPECIFIC DESCRIPTION

Referring now to the drawings, FIG. 1 illustrates an example system embodiment generally designated by the reference numeral 100. System 100 includes a substrate 10, a source 14, such as, for example, an ion particle accelerator, a radioactive source, or an electromagnetic source of radiation (e.g., a laser), that is capable of directing a substantially collimated beam of particles (denoted by p in FIG. 1) at one or more applied materials 18, and a means 20 for measuring an energy differential of a transmitted beam of particles produced by source 14.

In an example method of the invention, an applied (e.g., deposited or adsorbed) material 18 on a predetermined substrate 10 is substantially illuminated with a directed and substantially collimated beam source 14. Thereafter, an accurate and sensitive energy differential of less than about 10% variance of down to about 10 ng is capable of being measured that corresponds to an absorbed energy of the applied macromolecule. Such a measured absorbed energy correlates to a quantitative amount of mass of the material.

Specifically, material 18, such as a macromolecule that includes, but is not limited to, nucleic acids, amino acids, oligonucleotides, polyribonucleotides, polydeoxribonucleotides, polypeptides, proteins, antigens, carbohydrates, lipids and/or any non-volatile biomolecule or complex thereof is applied onto the surface of an inorganic (e.g., silicon nitride, boron nitride, etc.) or an organic (e.g., mylar, nylon, formvar, etc.) substrate 10, which is integrally attached to a supporting frame 24 of pure silicon. Substrate 10 can be designed to have a homogeneous region of thickness between about 80 and about 1000 nm which forms a window to enable analysis of material 18 by multiple non-destructive analysis or post destructive analysis if necessary. Such non-destructive analysis includes determining the mass of material 18 relative to the very small amount of the mass of the window suspending such material by measuring the energy loss of a substantially collimated source of directed accelerated particles such as, protons, helium ions, or oxygen ions having an energy between about 3 and about 5 MeV or electromagnetic radiation from about the x-ray spectrum to about the infra-red region due to the adsorption of applied material 18. For example, energy loss can be measured on such substrates 10 of the present invention by incorporating conventional methods such as Scanning Transmission Ion Microscopy (STIM) or alpha spectroscopy. It is to be appreciated that the substantially collimated feature of the beam produced by source 14 avoids attenuation or scattering at the intersection region 15 of substrate 10, which is integrally attached to supporting frame 24. Moreover, it is also to be appreciated that the thinness of the sample, as disclosed hereinbefore, improves x-ray fluorescence techniques because the background noise due to bremstrahling or scattering of x-rays is reduced, thereby increasing the signal to noise ratio of such techniques.

An inorganic or organic substrate can be fabricated from silicon wafers using masks to produce the thin layers by chemical etching. For example, a 4" silicon wafer can be masked with window areas that are about 3×3 mm square with scoring lines that are about 150 micrometers wide and spaced about 5 mm apart. A mask is deposited on one side of the wafer where silicon nitride will not be allowed to be deposited. The wafer is then coated with between about 100 and about 500 nm of silicon nitride. The mask is removed and the wafer is then placed into a Pottasium hydroxide (KOH) chemical etch to remove the silicon on the side of the wafer that is not coated with silicon nitride. This leaves the thin coating of silicon nitride forming a window portion, shown as substrate 10 in FIG. 1, having, for example, a dimension of about 2×2 mm square suspended by a frame of silicon (i.e., integrally attached frame 24) that is about 5×5 mm square. The window thus formed is smaller than the mask because of the process of the chemical etching.

A thin coating between about 50 and about 100 nm of a metal, such as, for example, aluminum, gold, etc., can be sputtered or evaporated onto the surface so that the surface is conductive. Such a conductive coating allows a static voltage to be applied to attract, for example, micro-sprayed molecules to a predetermined localized area on the surface. It is to be appreciated that such a conductive coating also operates as a desorption surface for mass spectrometry techniques such as, for example, Matrix-assisted desorption ionization Time Of Flight Mass Spectrometry (MALDI-TOF/MS), Surface Enhanced Laser Desorption Ionization Mass Spectrometry (SELDI-MS), Particle Induced Desorption Mass Spectrometry (PIDMS), or Secondary Ion emission Mass Spectrometry (SIMS).

Such a coating can also be altered to facilitate sample adsorption, or sample deposition by electrospray, microelectrospray, or sample analysis by other methods known to those skilled in the art to produce a functionalized coating. For example, thiol derivative compounds (i.e., a group of organosulphur compounds that are derivatives of hydrogen sulfide) can be applied to the gold or metal coating and provide a hydrophobic surface, or provide specific interactions to bind molecules of interest.

As another application, applied sample materials are also capable of being digested by enzymes and its fragments qualitatively measured by such methods, that includes, but is not limited to, MALDI-mass spectrometry, which identifies trypsin-fragmented proteins by measuring masses of the fragments, and/or Accelerator mass spectrometry (AMS), which is capable of quantifying long-lived radioisotopes (e.g., 3H, 14C, 41CA, etc.) within or ligands bound to the material. In addition, DNA can be extracted from the thin substrate after such non-destructive analysis and such DNA can be amplified for Polymerase Chain Reaction (PCR) for comparison.

Returning again to FIG. 1, the energy loss can also be detected and measured by means 20, which includes energy loss detectors, such, as, but not limited to, materials fabricated to be a detector, a surface barrier detector, an ion-depleted silicon detector, a pin diode, a CCD array, or a high resistance silicon wafer, whereby either of these types of detectors can be arranged to measure the transmitted energy that passes through material 18. In addition, means 20 can be configured to include an incorporated reference region (not shown), such as, a bare region not having an applied material 18 on the formed window of substrate 10, or a detector chip, such as, for example a pin photodiode, to provide a reference measurement of the beam that is not attenuated by material 18. The corresponding energy differential between the attenuated and the reference measurement correlates to a quantitative amount of mass of material 18 by comparing such measured energy differentials with national calibrated and documented standards as known by those in the art.

The material 18 as shown in FIG. 1, is also capable of being operationally deposited or adsorbed directly onto an energy loss detector. As an example, the material can be applied to a localized site on a large area energy loss detector's input surface, designed to also operate as a substrate for a sample material of interest. A directed substantially collimated beam, such as, for example, an ion particle accelerator is then directed to target the sample material being quantified and a small amount of, for example, between about 5 and about 10% of the area of the bare detector around the sample material, such that an energy differential is capable of being measured. In this arrangement, up to about 40,000 samples having a localized site long dimension of about 20 microns can be placed and quantified by such an example detector having a 1 $cm^2$ detection area. Such an arrangement also enables analysis by multiple non-destructive methods followed by destructive methods if necessary, including the detection of the mass of the material relative to the characteristics measured by other techniques for a same sample as previously described.

Figures 2A, 2B, 2C:
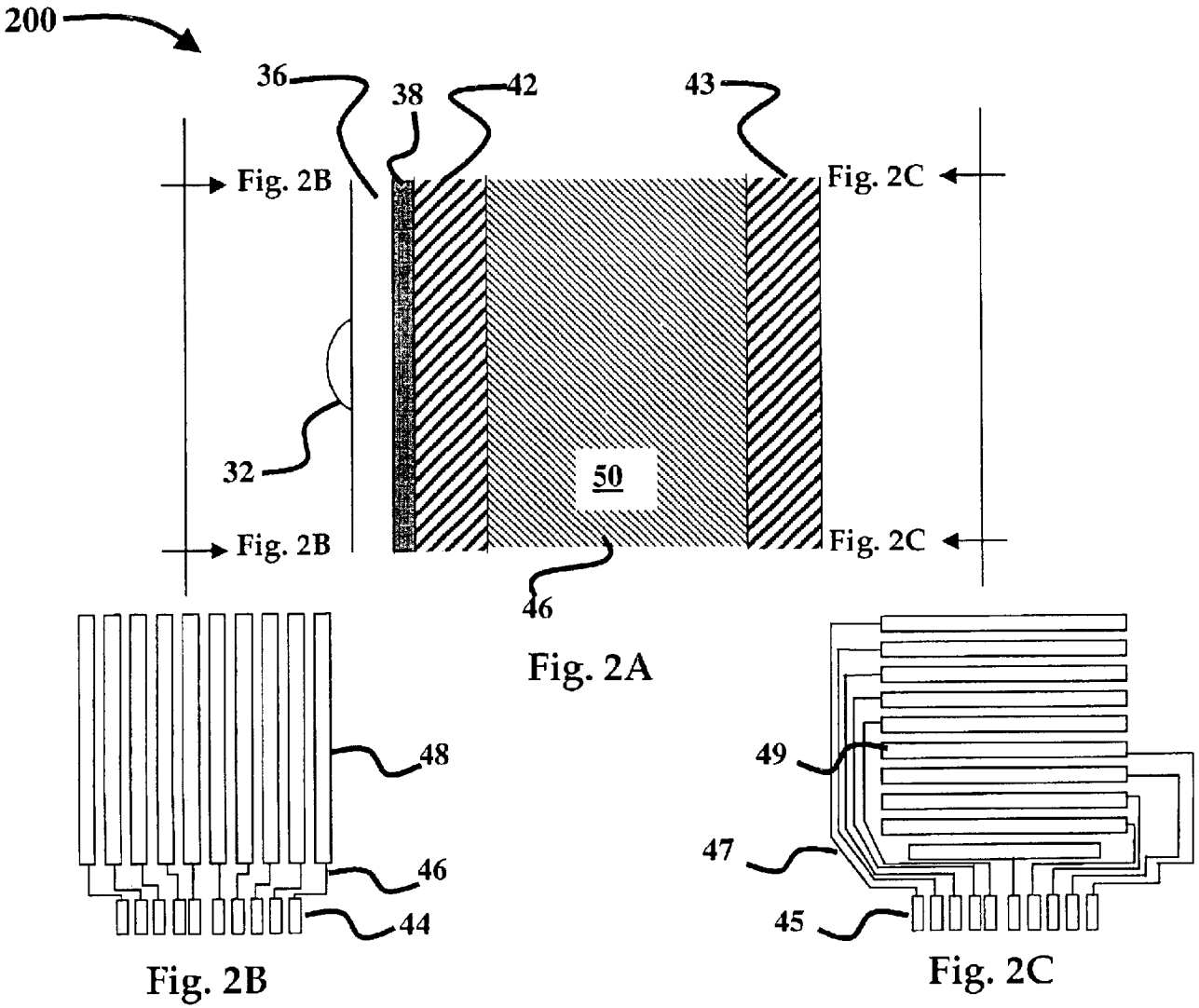
FIG. 2A shows an energy loss detector embodiment capable of measuring energy differentials as disclosed in the present invention.
FIG. 2B shows a patterned front lead of an energy loss detector.
FIG. 2C shows a patterned back lead of an energy loss detector.

FIG. 2A illustrates a cross-section of an example embodiment, designated by the reference numeral 200, wherein a high resistance, e.g., at least greater than about $10^7$ Ω-cm, silicon wafer 46, is capable of being coated, for example, by sputtering or evaporating a conductive metal, such as, but not limited to, gold, silver, etc., on predetermined surfaces of wafer 46 designed for electrical inputs. By applying a voltage potential between such electrical inputs, shown as front 42 and back 43 electrical leads in FIG. 1, wafer 46 can operate as an energy detector 50 (i.e., a surface barrier detector) and measure energies of a substantially collimated beam source (not shown) directed at sample material 32. A protective polymer coating 38 of about 250 nm in thickness can additionally be applied to electrical leads 42 and 43 to protect wafer's 46 surface from solvents that carry biological materials 32.

Moreover, a thin coating between about 50 and about 100 nm of a conductive metal, such as, for example, aluminum, gold, etc., can be sputtered or evaporated onto a surface, such as the polymer 38 surface. Such an applied conductive coating allows a static voltage to be applied to attract ionized molecules to a localized site on a surface while also operating as a desorption surface for mass spectrometry techniques, as discussed above in the description related to FIG. 1. In addition, a functionalized coating 36, as previously described above, can be added to facilitate sample adsorption, or sample deposition by electrospray, microelectrospray, or sample analysis by other methods known to those skilled in the art. Moreover, multiple non-destructive methods followed by destructive methods and surface alterations to enhance, for example, binding of predetermined molecules as described above, is also applicable in this embodiment.

FIG. 2B and FIG. 2C illustrates an improved arrangement wherein the electrical leads formed from metal coatings 42 and 43, as shown in FIG. 2A, are patterned for analysis of multiple samples. For example, by applying a voltage potential at a plurality of inputs 44 and 45 that connect by a plurality of lines 46 and 47 to a patterned front set of leads, 48 and an orthogonal patterned back set of leads 49, as shown in FIG. 2B and FIG. 2C, respectively, specific overlap regions due to a resultant grid of the patterned leads can operate as individual detectors. This arrangement enables a plurality of samples to be measured while remaining compatible with other methods of analysis including quantitating the elemental or isotopic content, identifying the material or using the material in biochemical analysis.

To separate individual samples after the measurement requires that wafer 46, as shown in FIG. 2A, be constructed with etched score lines. During construction, the silicon wafer is masked with lines that are 150 micrometers wide and spaced between the regions where the metal coating as placed. Wafer 46, is coated with between about 100 and about 500 nm of silicon nitride (SiN) which operates as a mask for silicon etching using KOH. The nitride is patterned using photolithography and reactive ion etching (RIE). KOH is used to etch trenches in silicon that facilitates breaking of the silicon wafer into individual samples. The resist mask for the metal patterning is then photolithographically applied to the wafer for each side.

It should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A system, comprising:

a substrate, configured to receive one or more localized materials applied thereon, wherein each of the localized materials are arranged to receive a directed beam of particles; and means for measuring an energy differential of the directed beam of particles to determine a quantitative amount of mass of each of the localized materials, the energy differential comprising a directed transmitted energy of the beam of particles through the substrate and a respective applied material, and a measured energy of the beam of particles via a reference region.

2. The system of claim 1, wherein the measuring means includes one of: scanning transmission microscopy and molecular alpha spectrometry.

3. The system of claim 1, wherein the reference region includes a reference chip.

4. The system of claim 1, wherein the reference region includes a bare region on the substrate.

5. The system of claim 1, wherein the substrate has a thickness between about 80 nm and about 1000 nm integrally attached to a supporting frame.

6. The system of claim 5, wherein the substrate includes an inorganic material comprising one of: silicon nitride and boron nitride.

7. The system of claim 5, wherein the substrate includes an organic material comprising one of: mylar, nylon, and formvar.

8. The system of claim 5, wherein the substrate includes at least one coating.

9. The system of claim 8, wherein the coating includes a metal comprising at least one of: gold, aluminum, and silver.

10. The system of claim 1, wherein the substrate includes an input surface of a detector comprising one of: a surface barrier detector, an ion-depleted silicon detector, a pin diode, a CCD, and a high resistance silicon wafer.

11. The system of claim 1, wherein the materials include a macromolecule comprising at least one from: nucleic acids, amino acids, oligonucleotides, polyribonucleotides, polydeoxribonucleotides, polypeptides, proteins, antigens, carbohydrates, and lipids.

12. The system of claim 1, wherein an amount between about 0.08 and about 100 $\mu$g of applied macromolecules is capable of being quantified.

13. The system of claim 1, wherein the particles include electromagnetic radiation.

14. The system of claim 13, wherein the electromagnetic radiation include photons from about x-rays to about the near-infrared.

15. The system of claim 1, wherein the particles include accelerated particles.

16. The system of claim 15, wherein the accelerated particles comprise at least one of: protons, helium ions, and oxygen ions.

17. The system of claim 1, wherein the beam is substantially collimated.

18. An apparatus, comprising:

an energy loss detector, configured to operationally receive one or more localized macromolecules applied thereon, wherein a respective area that includes each of the applied localized macromolecules are arranged to receive a directed beam of particles to produce one or more localized detectors; and electronics operatively coupled to the energy loss detector and configured to measure an energy differential comprising: a measured transmitted beam energy of the directed beam of particles through the one or more localized macromolecules by the localized detectors, and a measured beam energy of the directed beam of particles via a reference region, the measured energy differential corresponding to an absorbed energy by the applied localized macromolecules so as to determine a quantitative amount of mass of each of the respective macromolecules.

19. The apparatus of claim 18, wherein the reference region includes a bare region on the energy loss detector.

20. The apparatus of claim 18, wherein the energy loss detector comprises one from: a surface barrier detector, an ion-depleted silicon detector, a pin diode, a CCD, and a high resistance silicon wafer.

21. The apparatus of claim 20, wherein the detector includes a front and a back surface each having a metal coating applied thereon.

22. The apparatus of claim 21, wherein the metal coating on the front surface includes a polymer coating.

23. The apparatus of claim 22, wherein the polymer coating includes a functionalized coating for binding of the macromolecules.

24. The apparatus of claim 18, wherein the macromolecules comprise at least one from: nucleic acids, amino acids, oligonucleotides, polyribonucleotides, polydeoxribonucleotides, polypeptides, proteins, antigens, carbohydrates, and lipids.

25. The apparatus of claim 18, wherein the macromolecules comprise a non-volatile isolated biomolecule and/or complex.

26. The apparatus of claim 18, wherein each of the respective areas receives a substantially collimated beam of particles.

27. An apparatus, comprising:

a wafer, having a metallic pattern of lines on a front and a back surface, wherein the respective patterns are arranged to produce one or more individual detectors, the detectors configured to receive a localized macromolecule thereon and additionally configured to receive a directed beam of particles; and electronics operatively coupled to the detectors and configured to measure an energy differential to determine a quantitative amount of mass of each of the respective macromolecules, comprising:

a measured transmitted beam energy of the directed beam of particles through the localized macromolecule by the individual detectors and a measured beam energy of the directed beam of particles via a reference region, the measured energy differential corresponding to an absorbed energy by the applied localized macromolecule.

28. The apparatus of claim 27, wherein the patterns on the front surface are substantially orthogonal to the patterns on the back surface to produce a grid of individual detectors.

29. The apparatus of claim 28, wherein the patterns on the front surface includes a polymer coating.

30. The apparatus of claim 29, wherein the polymer coating includes a functionalized coating for binding of the macromolecules.

31. The apparatus of claim 27, wherein the reference region includes a bare region on the wafer.

32. The apparatus of claim 27, wherein the wafer is a high resistance silicon wafer.

33. The apparatus of claim 27, wherein the macromolecules comprise at least one from: nucleic acids, amino acids, oligonucleotides, polyribonucleotides, polydeoxribonucleotides, polypeptides, proteins, antigens, carbohydrates, and lipids.

34. The apparatus of claim 27, wherein the macromolecules comprise a non-volatile isolated biomolecule and/or complex.

35. The apparatus of claim 27, wherein each of the localized macromolecules receives a respective substantially collimated beam of particles.

36. A method, comprising:

applying one or more localized materials on a substrate, directing a beam of particles at a respective localized material, wherein each of the respective localized materials is configured to receive a predetermined fraction of the beam; and measuring an energy differential of a transmitted beam of particles to determine a quantitative mass of each of the localized materials, the measured energy differential corresponding to an absorbed energy by the applied localized macromolecules.

37. The method of claim 36, wherein measuring includes one of: scanning transmission ion microscopy and molecular alpha spectrometry.

38. The method of claim 36, wherein measuring includes the detected beam's transmitted energy through the substrate and a respective applied macromolecule, and a measured beam energy via a reference region.

39. The method of claim 36, wherein the reference region includes a reference chip.

40. The method of claim 36, wherein the reference region includes a bare region on the substrate.

41. The method of claim 36, wherein the substrate is a thin substrate between about 80 and about 1000 nm integrally attached to a supporting frame.

42. The method of claim 36, wherein the substrate includes an input surface of a detector comprising one of: a surface barrier detector, an ion-depleted silicon detector, a pin diode, a CCD, and a high resistance silicon wafer.

43. The method of claim 42, wherein the silicon wafer is a metallic patterned wafer.

44. The method of claim 36, wherein the materials include a macromolecule comprising at least one of: nucleic acids, amino acids, oligonucleotides, polyribonucleotides, polydeoxribonucleotides, polypeptides, proteins, antigens, carbohydrates, and lipids.

45. The method of claim 36, wherein an amount between about 0.08 and about 100 $\mu$g of the applied materials is capable of being quantified.

* * * * *